US005669091A

United States Patent [19]

Chung

[11] Patent Number: 5,669,091

[45] Date of Patent: Sep. 23, 1997

[54] STRUCTURE OF WATER BED

[76] Inventor: Ming-Chun Chung, 7F, No. 22, Alley 3, Lane 227, Nung An Street, Taipei, Taiwan

[21] Appl. No.: 616,189

[22] Filed: Mar. 15, 1996

[51] Int. Cl.[6] ..... A47C 27/10

[52] U.S. Cl. ..... 5/687; 5/665

[58] Field of Search ..... 5/451, 452, 455, 5/449, 450, 665, 678, 680, 681, 682, 683, 687

[56] References Cited

U.S. PATENT DOCUMENTS

| | | | |
|---|---|---|---|
| 4,558,476 | 12/1985 | Linder | 5/451 |
| 4,638,518 | 1/1987 | Barbulla | 5/452 |
| 4,727,607 | 3/1988 | Nystad | 5/451 |
| 5,065,465 | 11/1991 | Nystad | 5/451 |
| 5,513,400 | 5/1996 | Turner | 5/451 |

*Primary Examiner*—Alexander Grosz
*Attorney, Agent, or Firm*—Beveridge, DeGrandi, Weilacher & Young, L.L.P.

[57] ABSTRACT

A water bed which includes a soft frame; a peripheral air bag mounted within the soft frame; a water bag mounted within the soft frame and surrounded by the peripheral air bag, the water bag comprising three pairs of opposing plastic lining walls sealed together, at least one water valve for permitting water to be filled into the water bag, and a plurality of through holes through the plastic lining walls for the passing of water, the plastic lining walls including a top plastic lining wall and a bottom plastic lining wall, each of the top plastic lining wall and bottom plastic lining wall of the water bag having two sealing lines at two opposite sides respectively sealed to respective outer side edges of a respective sides of the periphery air bag; an intermediate air bag mounted within the water bag, the intermediate air bag comprising at least one air valve extending out of the water bag and the soft frame, a plurality of partition stretchers, each of the partition stretchers having at least one air hole, and a plurality of air chambers separated by the partition stretchers and communicating with one another by the air holes of the partition stretchers; a plurality of stretcher sheets respectively mounted inside the water bag and sealed to the plastic lining walls of the water bag and the periphery of the internal air bag; and a water-tight outer layer covered around the soft frame, the peripheral air bag, and the water bag.

5 Claims, 10 Drawing Sheets

STRUCTURE OF WATER BED

BACKGROUND OF THE INVENTION

The present invention relates to water beds, and relates more particularly to such a water bed which comprises a soft frame, a peripheral air bag mounted within the soft frame, a water bag mounted within the soft frame and surrounded by the peripheral air bag, and an internal air bag mounted within the water bag to buffer water waves.

Various water beds have been disclosed, and have appeared on the market. However, regular water beds tend to vibrate when the user lies on it or leaves away from it. Furthermore, the stiffness of these water beds cannot be conveniently adjusted when filled up with water. There is known another type of water bed which has a peripheral air bag mounted within the frame around the water bag. The stiffness of this type of water bed can be conveniently adjusted by changing the inside air pressure of the peripheral air bag. However, this type of water bed is still not satisfactory in function because the peripheral air bag tend to be deformed when inflated, and its sealing area tends to be torn up.

SUMMARY OF THE INVENTION

The present invention has been accomplished to provide a water bed which eliminates the aforesaid drawbacks. It is one object of the present invention to provide a water bed which holds the water bag in shape when in use. It is another object of the present invention to provide a water bed which has means to buffer the movement of water in the water bag thereof. It is still another object of the present invention to provide a water bed which effectively prevents loss of heat energy when the water bag thereof is heated. It is still another object of the present invention to provide a water bed which can be conveniently adjusted to change the stiffness to the desired level. It is still another object of the present invention to provide a water bed which is durable in use.

According to one aspect of the present invention, the water bed comprises a soft frame; a peripheral air bag mounted within the soft frame; a water bag mounted within the soft frame and surrounded by the peripheral air bag, the water bag comprising three pairs of opposing plastic lining walls sealed together, at least one water valve for permitting water to be filled into the water bag, and a plurality of through holes through the plastic lining walls for the passing of water, the plastic lining walls including a top plastic lining wall and a bottom plastic lining wall, each of the top plastic lining wall and bottom plastic lining wall of the water bag having two sealing lines at two opposite sides respectively sealed to respective outer side edges of a respective sides of the periphery air bag; an intermediate air bag mounted within the water bag, the intermediate air bag comprising at least one air valve extending out of the water bag and the soft frame, a plurality of partition stretchers, each of the partition stretchers having at least one air hole, and a plurality of air chambers separated by the partition stretchers and communicating with one another by the air holes of the partition stretchers; a plurality of stretcher sheets respectively mounted inside the water bag and sealed to the plastic lining walls of the water bag and the periphery of the internal air bag; and a water-tight outer layer covered around the soft frame, the peripheral air bag, and the water bag.

According to another aspect of the present invention, the soft frame can be made in two forms. In one form, the soft frame comprises a hollow plastic cover layer stuffed with stuffing material. In the other form, the soft frame is an air bag defined by a plurality of partition stretchers thereof into a plurality of air chambers respectively communicating with one another by air holes on the partition stretchers.

DETAILED DESCRIPTION OF THE PREFERRED EMBODIMENT

Figure 1:
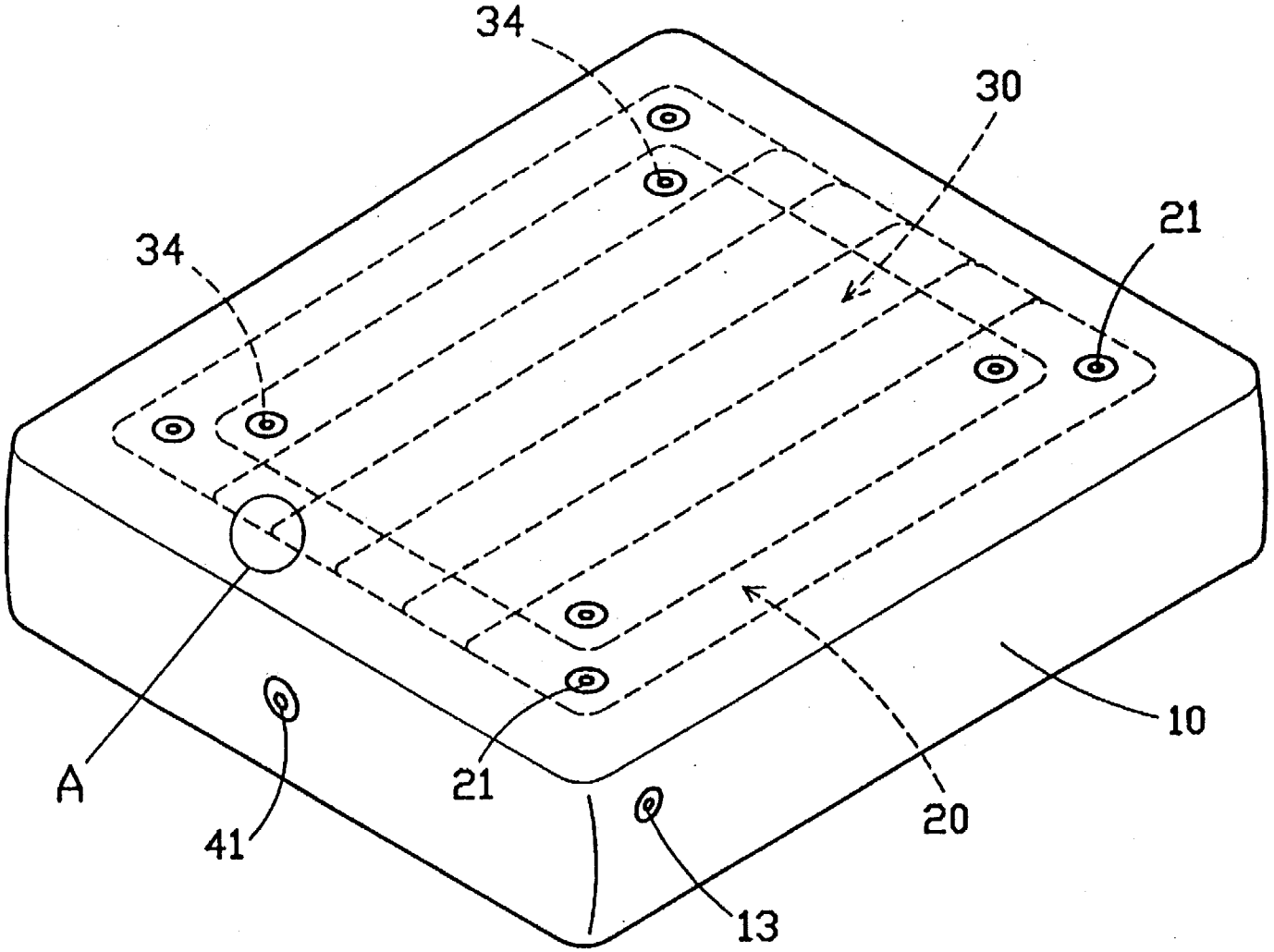
FIG. 1 an elevational view of a water bed according to the present invention.
Figure 1A:
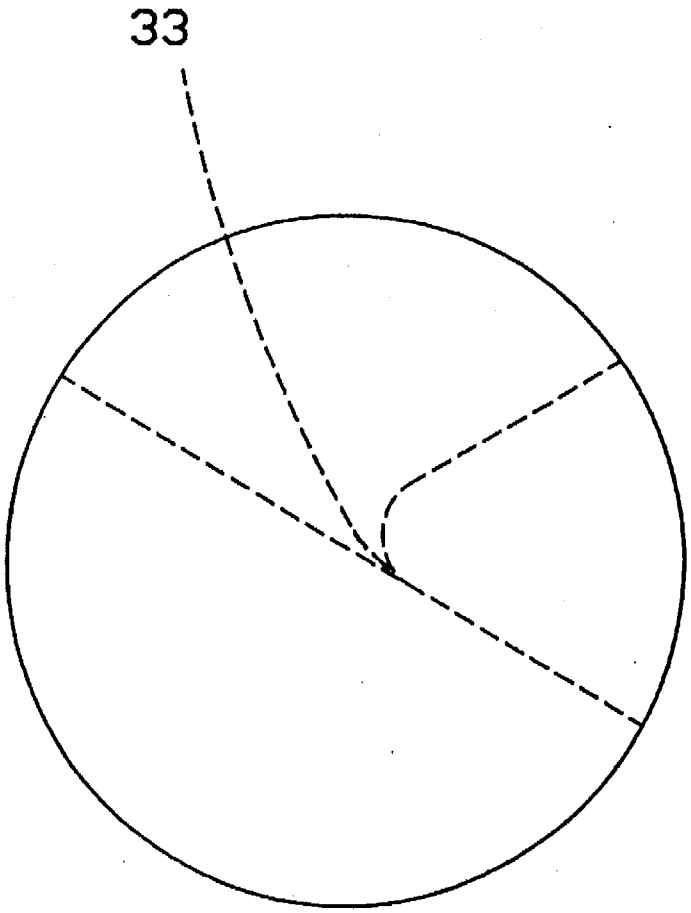
FIG. 1A is an enlarged view of a part of FIG. 1.
Figure 2:
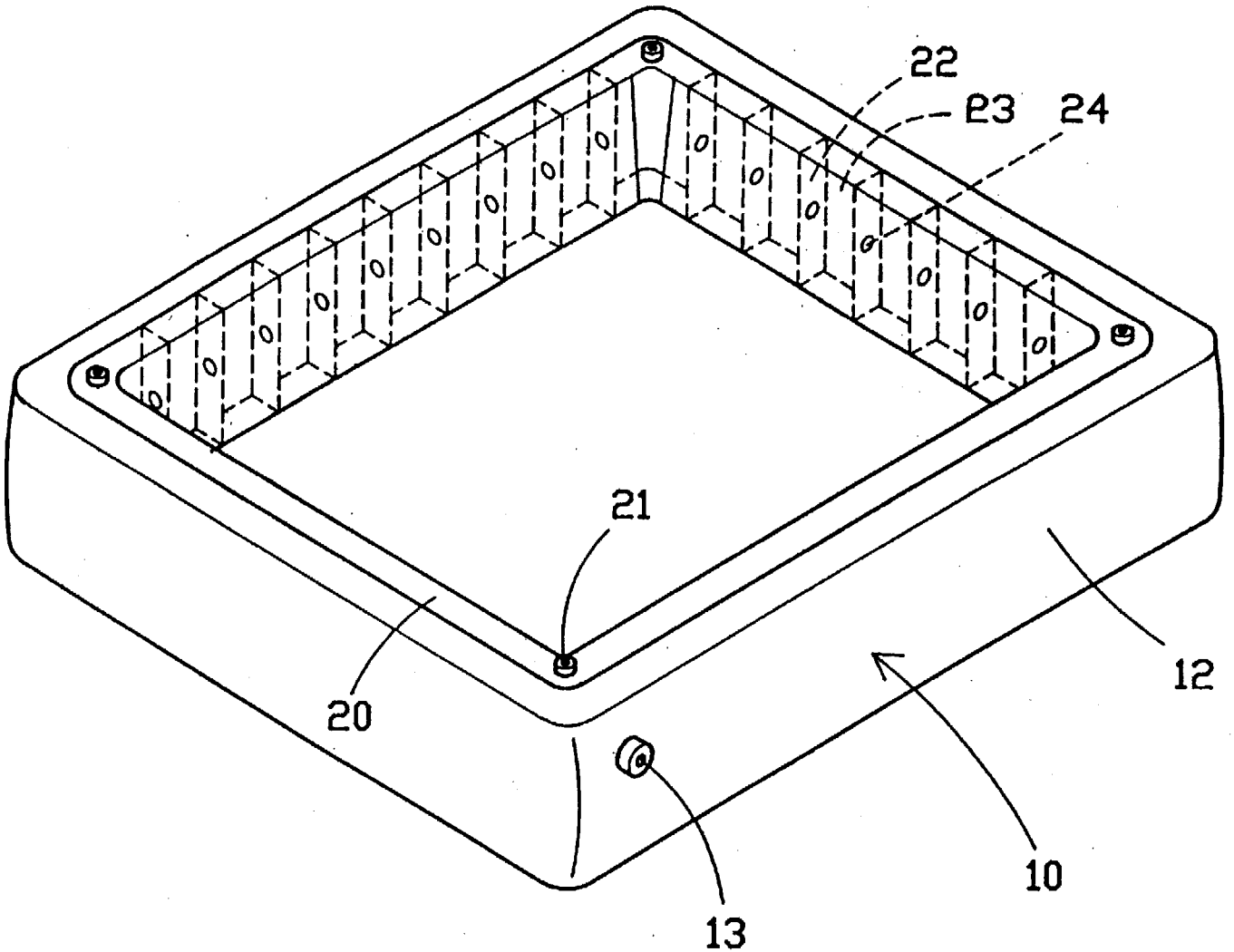
FIG. 2 shows the peripheral air bag mounted within the frame according to the present invention.

Referring to Figures from 1 to 4, a water bed in accordance with the present invention is generally comprised of a soft frame 10, a peripheral air bag 20, a water bag 30, and internal air bag 40, and stretcher sheets 50.

The frame 10 has a recessed structure, which holds the peripheral air bag 20 and the water bag 30 within the peripheral air bag 20, comprised of a hollow plastic cover layer 12, and stuffing material 11 stuffed in the plastic covering 12. The stuffing material 11 can be sponge or any suitable material having the same springy power or density. A plurality of air valves 13 are mounted in the plastic covering 12 of the frame 10, so that air can be driven into the frame 10 to regulate the stiffness of the frame 10. The stuffing material 11 also serves as heat-insulative means to stop heat energy from escaping the water bag 30.

The peripheral air bag 20 is mounted within the recessed frame 10, having a plurality of air valves 21 at the top in each corner, and a plurality of partition stretchers 22 connected between opposing inside walls and defining the inside space of the peripheral air bag 20 into a plurality of air chambers 23. Each of the partition stretchers 22 has at least one air hole 24 which permits air to circulate through the air chambers 23. The partition stretchers 22 support the periphery air bag 20 in the desired shape when the periphery air bag 20 is inflated. The partition stretchers 22 can have a square shape, triangular shape, rectangular shape, or any of a variety of shapes.

Figure 7:
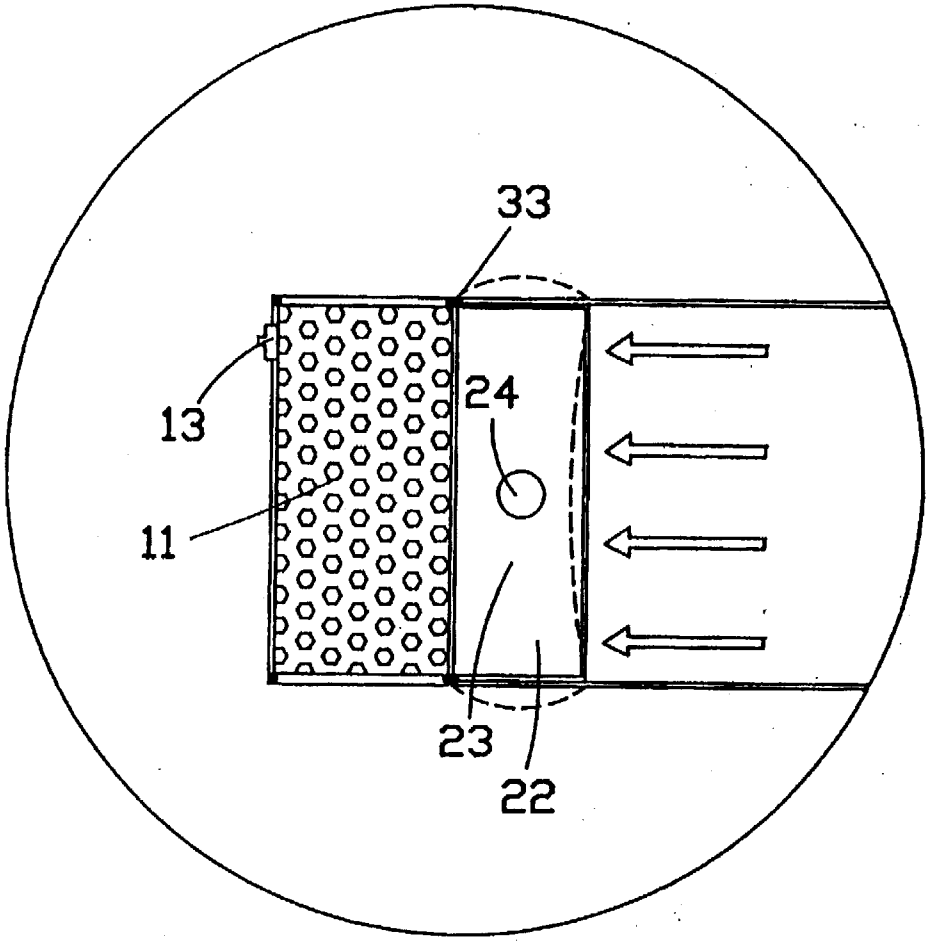
FIG. 7 is a partial in section of FIG. 3, showing the pressure sideways water waves buffered by the peripheral air bag according to the present invention.

The water bag 30 is mounted within the peripheral air bag 20 inside the frame 10, having three pairs of opposing plastic lining walls 31 sealed together, a plurality of water valves 34 at the top for permitting water to be filled into the water bag 30, and a plurality of through holes 32 through the plastic lining walls 31 for the passing of water to prevent the plastic lining walls 31 from being excessively stretched. The top and bottom plastic lining walls 31 of the water bag 30 have respective sealing lines 33 respectively sealed to the outer side edges of the top and bottom sides of the periphery air bag 20 (see FIG. 7). When the peripheral air bag 20 is inflated, the top and bottom sides of the peripheral air bag 20 are stretched outwards and closely attached to the top and bottom plastic lining walls 31 of the water bag 30, therefore the pressure of downward water waves and sideways water waves are prohibited from forcing the sealing lines 33 of the plastic lining walls 30 apart from the top and bottom sides of the peripheral air bag 20.

The internal air bag 40 is mounted within the water bag 30, having an air valve 41 extending to the outside of the the water bed for permitting air to be driven into the internal air bag 40, and a plurality of partition stretchers 42 connected between opposing inside walls and defining the inside space of the internal air bag 40 into a plurality of air chambers 43. Each of the partition stretchers 42 has at least one air hole 44, which permits air to circulate through the air chambers 43. The partition stretchers 42 support the internal air bag 40 in the desired shape when the internal air bag 40 is inflated. They can be made of square shape, triangular shape, rectangular shape, or any of a variety of shapes.

Figure 3:
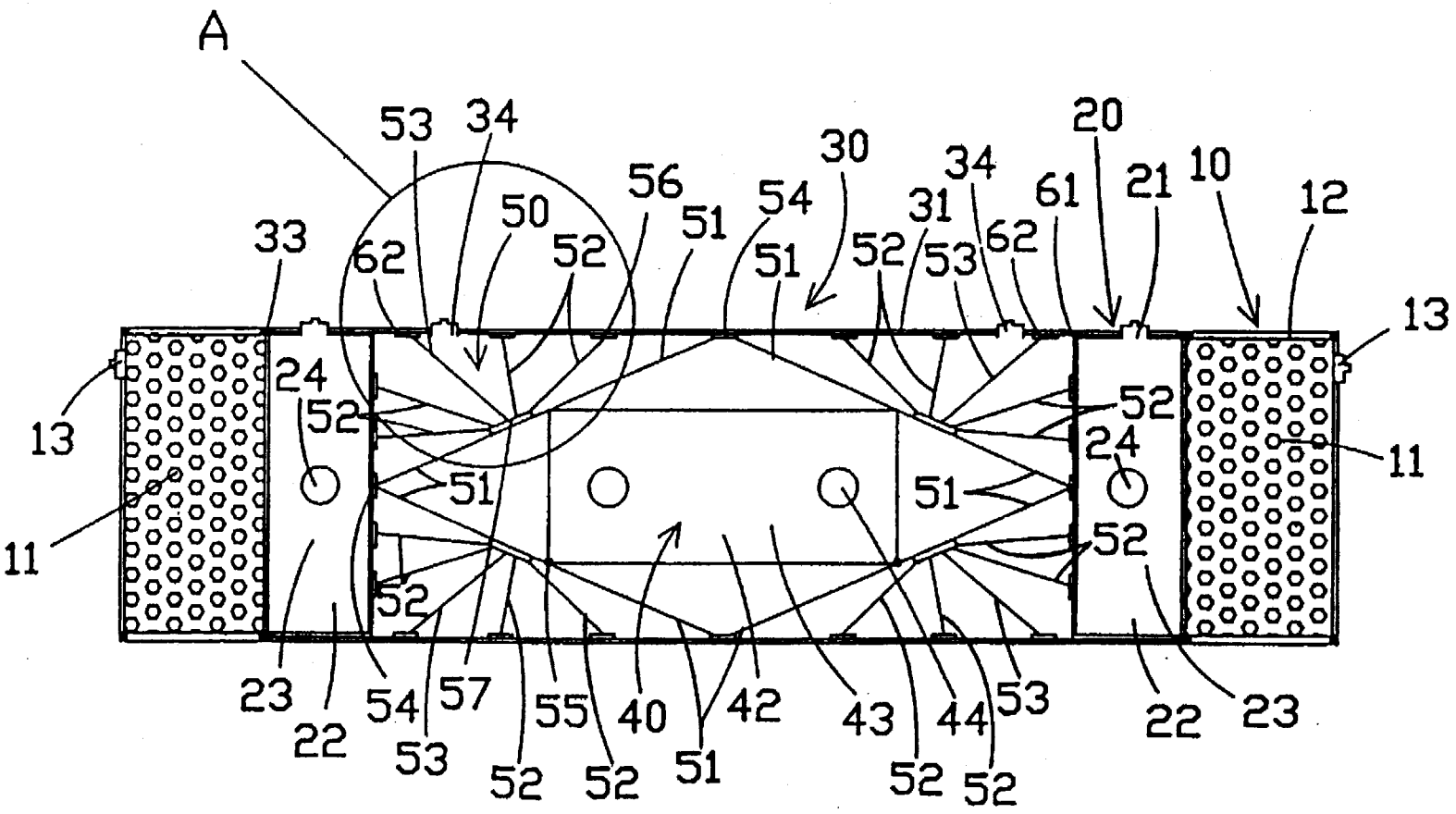
FIG. 3 is a cross sectional view of the water bed shown in FIG. 1.
Figure 3A:
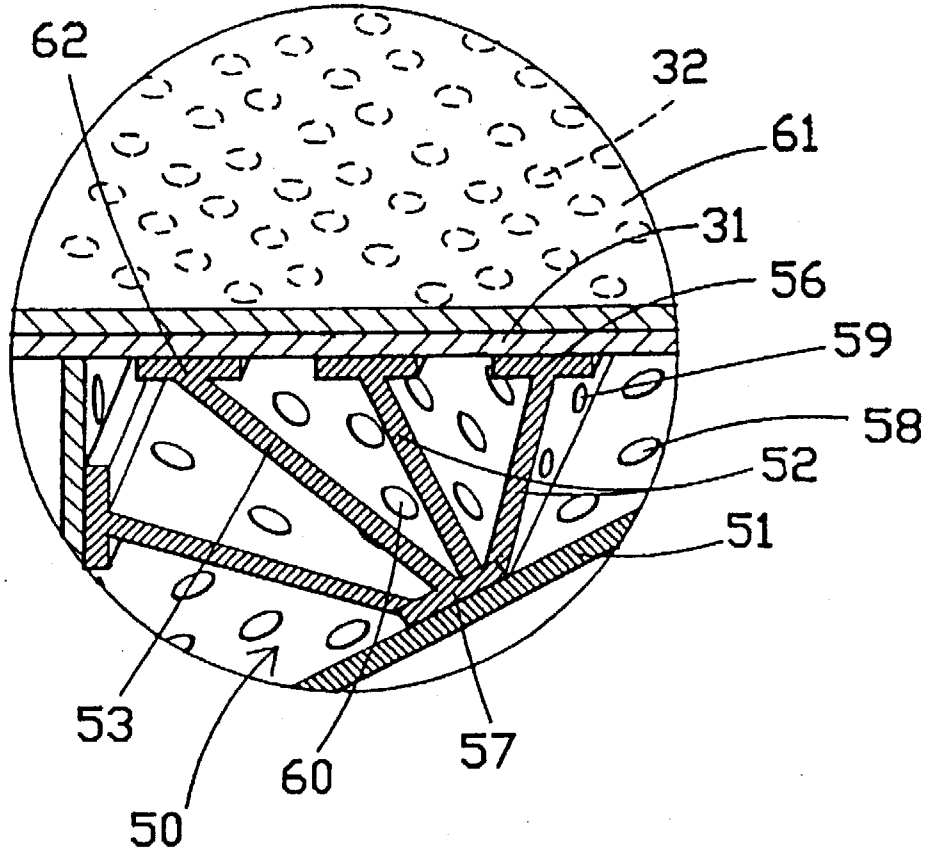
FIG. 3A is an enlarged view of a part of FIG. 3.
Figure 3B:
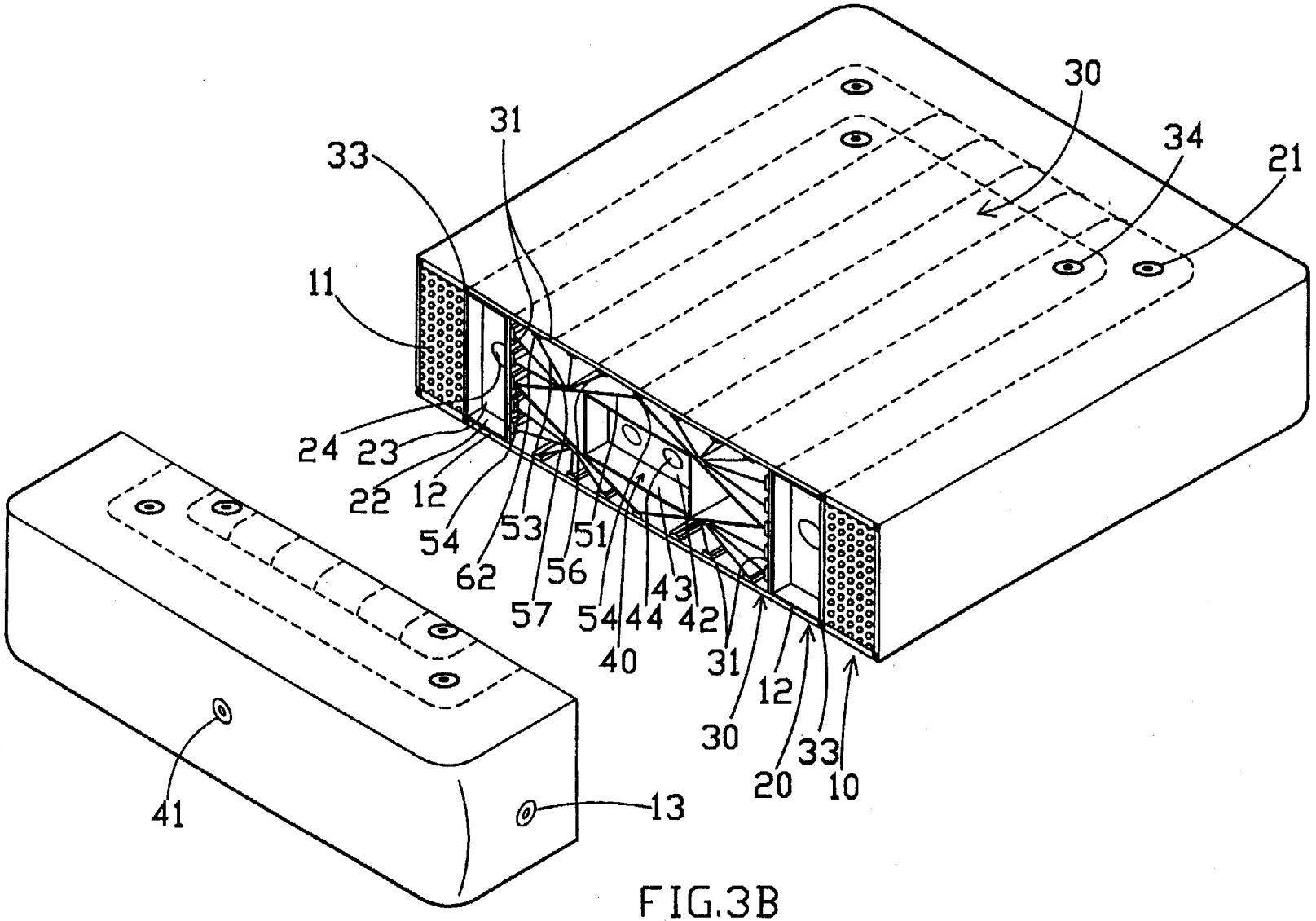
FIG. 3B is a cross sectional perspective view of the water bed shown in FIGS. 1 and 3.
Figure 4:
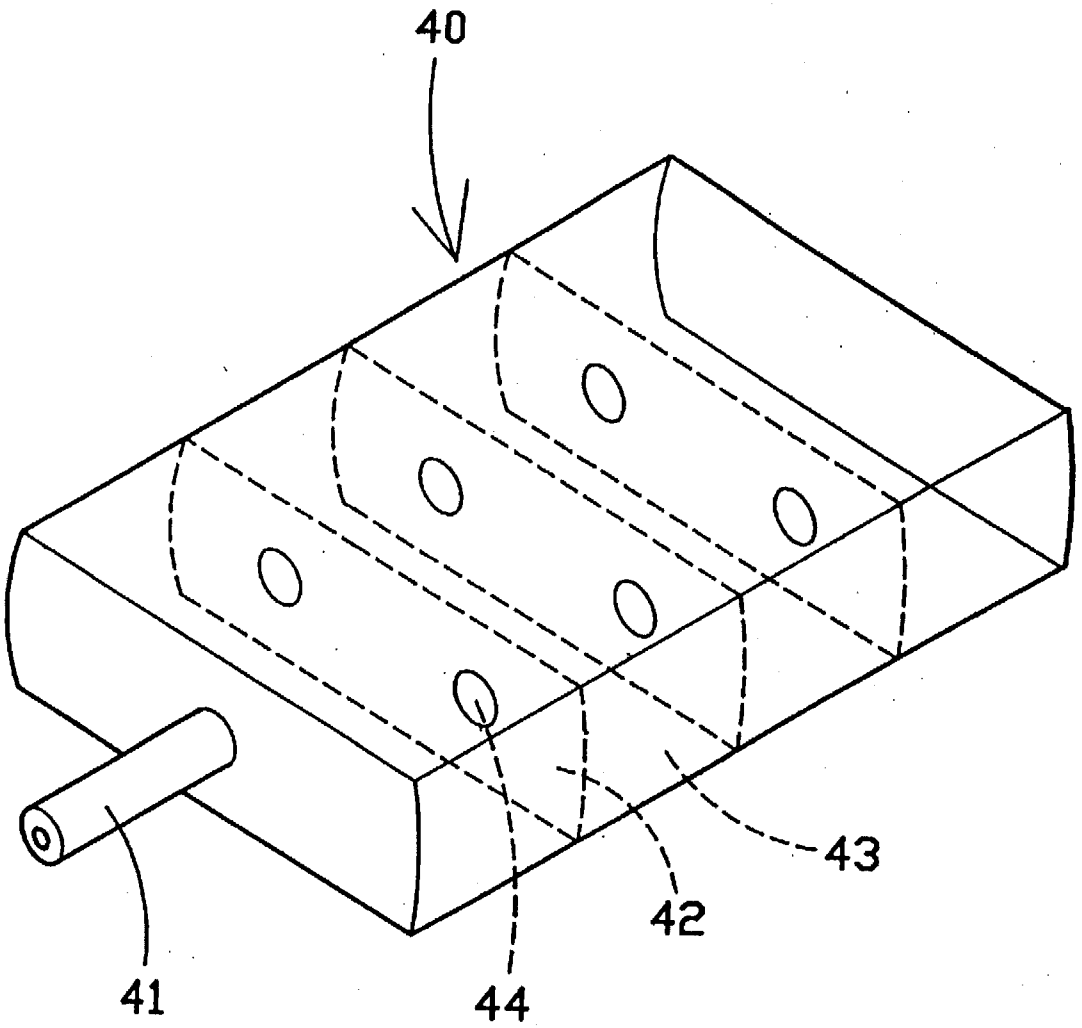
FIG. 4 is a perspective view of the internal air bag according to the present invention.

The stretcher sheets (generally designated by reference number 50) are sealed to the plastic lining walls 31 of the water bag 30 on the inside around the internal air bag 40, including a four first stretcher sheets 51, four sets of second stretcher sheets 52, and four third stretcher sheets 53. As best seen in FIGS. 3A and 3B, the stretcher sheets 50 run the length of the water bag 30. The four first stretcher sheets 50 are respectively sealed to the plastic lining walls 31 of the water bag 30 at sealing lines 54, and connected into a rhombic structure to hold the internal air bag 40 on the inside. Two of the first stretcher sheets 51 have a respective sealing line 55 respectively sealed to two opposing bottom side edges of the internal air bag 40. The second stretcher sheets 52 are respectively connected between a common sealing line 57 at each of the first stretcher sheets 51 and respective sealing lines 56 at the plastic lining walls 31 of the water bag 30. The four third stretcher sheets 53 are respectively connected between the sealing lines 57 at the first stretcher sheets 51, and respective sealing lines 62 at the plastic lining walls 31 of the air bag 40. The stretcher sheets 51, 52, 53 have respective through holes 58, 59, 60 for the passing of water. Furthermore, a water-tight outer layer 61 is covered around the frame 10, the peripheral air bag 20, and the water bag 30.

When the user lies on the water bag 30, the peripheral air bag 20 absorbs water waves to prevent the sealing lines 33 of the plastic lining walls 31 from being torn up. Therefore, the water bag 30 does not wear with use quickly.

As stated, the water bag 30 is supported within the peripheral air bag 20, and the internal air bag 40 is mounted within the water bag. When the peripheral air bag 20 and the internal air bag 40 are inflated by driving air into the air valves 41, 21, the stiffness of the water bag 30 is increased. By means of opening the air valves 21, 41 to release air from the peripheral air bag 20 and the internal air bag 40, the stiffness of the water bag 30 is reduced. Therefore, the stiffness of the water bag 30 can be regulated by changing the inside air pressure of the peripheral air bag 20 and the internal air bag 40.

Furthermore, because the internal air bag 40 is mounted inside the water bag 30, it will not be damaged easily. The internal air bag 40 serves also as a buffer means which lessens water waves. Therefore, the water bag 30 can be maintained stable. When the user lines on the water bed or leaves from it, water is forced to pass through the through holes 58, 59, 60 of the stretcher sheets 50, and the stretcher sheets 50 are vibrated to lessen water waves. Therefore, the stretcher sheets 50 and the internal air bag 40 act as buffer means to present water from being forced to move in a rush.

Figure 5:
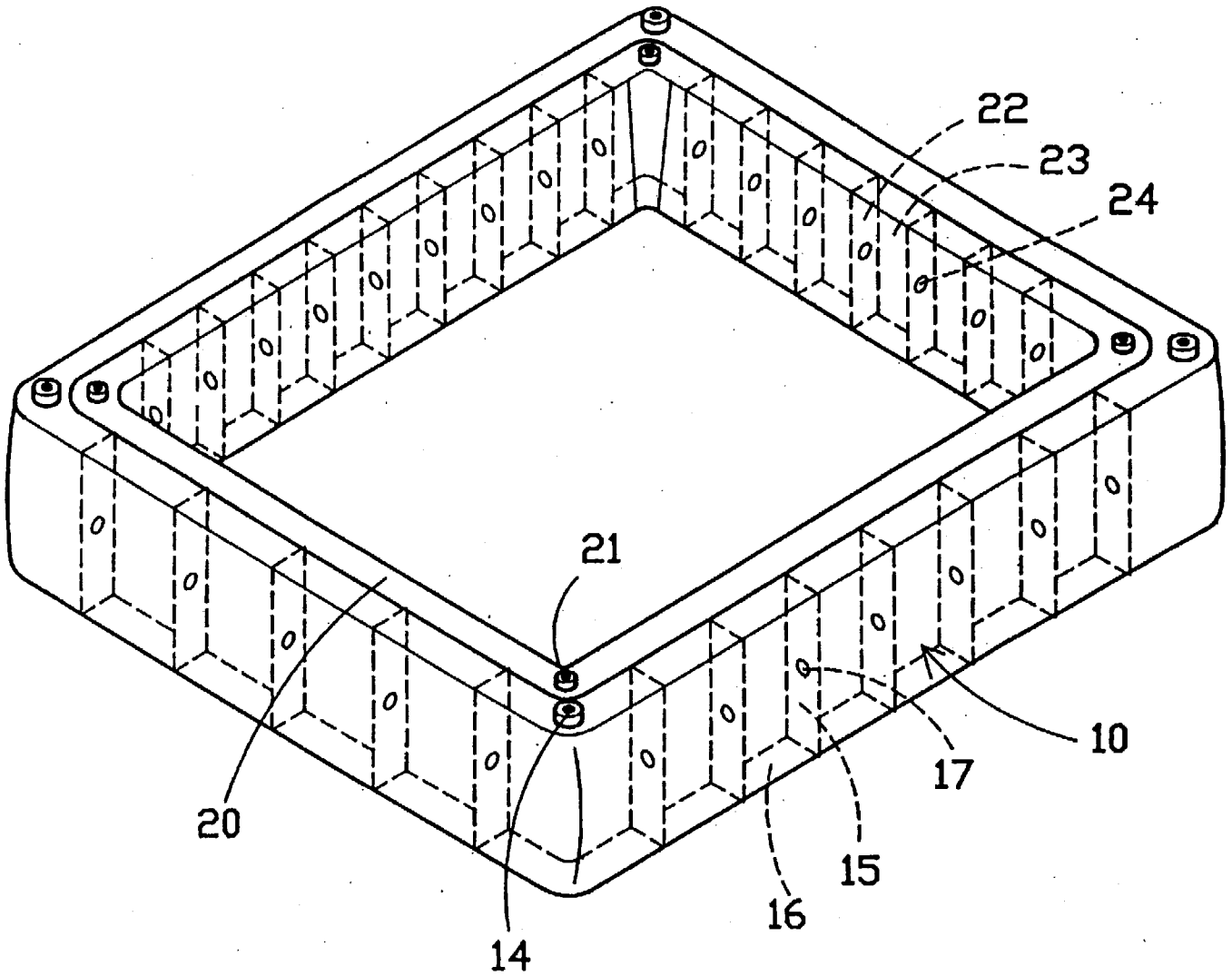
FIG. 5 is a perspective view of the frame and the periphery air bag according to a second embodiment of the present invention.
Figure 6:
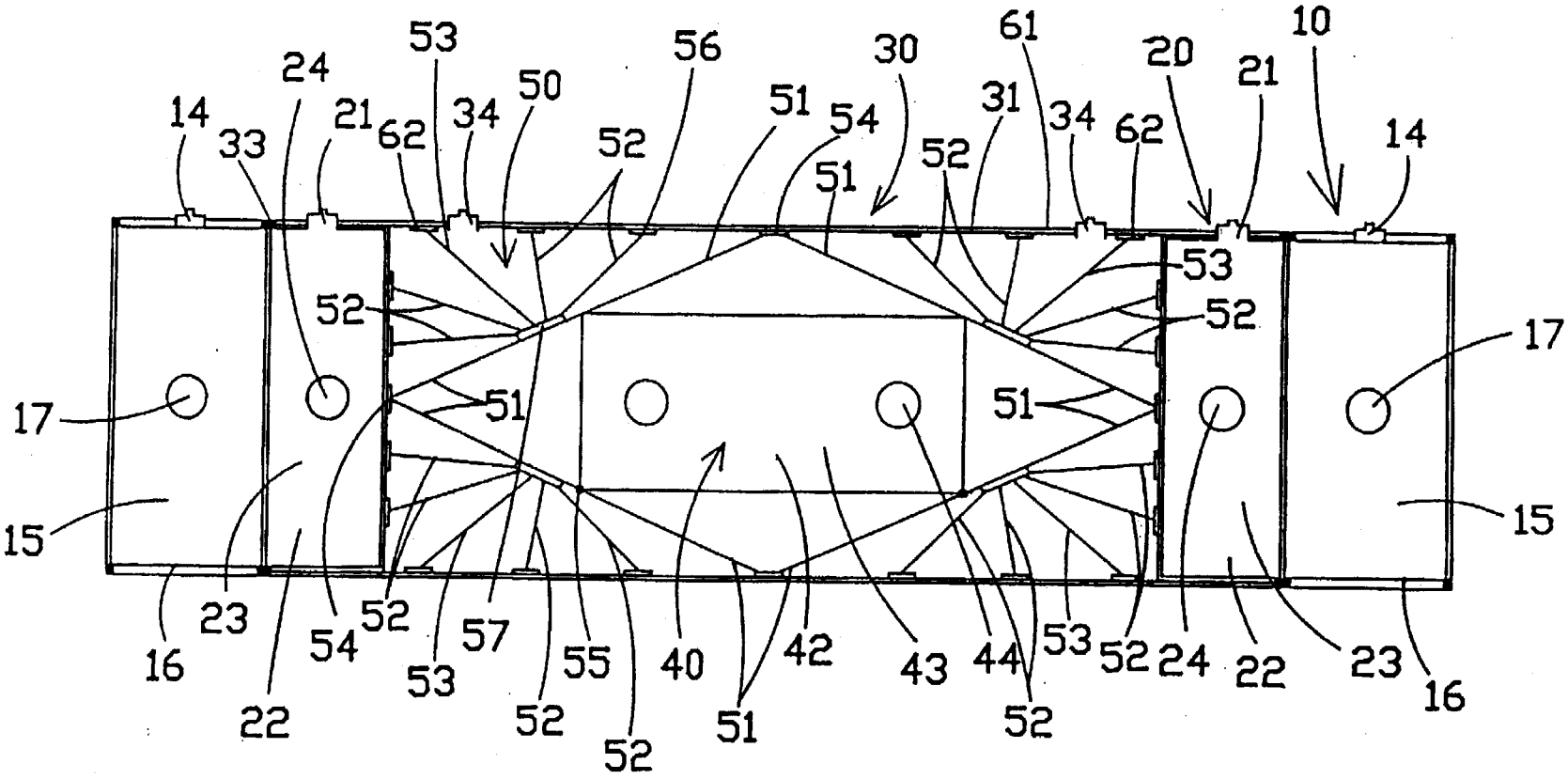
FIG. 6 is a cross sectional view of the water bed of the second embodiment of the present invention.

FIGS. 5 and 6 show an alternate form of the present invention, in which the frame 10 is made in the form of an air bag having a plurality of air valves 14 at the top for permitting air to be driven into the inside space of the frame 10, and a plurality of partition stretchers 15 connected between opposing inside walls and defining the inside space of the frame 10 into a plurality of air chambers 16. Each of the partition stretchers 15 has at least one air hole 17 which permits air to circulate through the air chambers 16. The partition stretchers 15 support the frame 10 in the desired shape when the frame 10 is inflated. The partition stretchers 15 can have a square shape, triangular shape, rectangular shape, or any of a variety of shapes.

It is to be understood that the drawings are designed for purposes of illustration only, and are not intended as a definition of the limits and scope of the invention disclosed.

What the invention claimed is:

1. A bed comprising:

a soft frame;

a peripheral air bag mounted within said soft frame;

a water bag mounted within said soft frame and surrounded by said peripheral air bag, said water bag including at least one water valve for permitting water flow into and out of said water bag, and said water bag being defined in part by a top plastic lining wall and a bottom plastic lining wall, said top and said bottom plastic lining walls of said water bag being sealably connected at two opposite sides to outer side edges of said peripheral air bag;

an intermediate air bag mounted within said water bag, said intermediate air bag including at least one air valve extending out of said water bag and said soft frame, and a plurality of air bag partition stretchers, each of said air bag partition stretchers having at least one air hole defined therein, said air bag partition stretchers defining a plurality of air chambers in communication with one another through said air holes of said partition stretchers;

a plurality of stretcher sheets respectively mounted inside said water bag and sealably connected between said water bag and said internal air bag; and a water-tight outer layer covering said soft frame, said peripheral air bag, and said water bag.

2. The water bed of claim 1 wherein said stretcher sheets include four first stretcher sheets sealed together into a rhombic structure and supporting said internal air bag, and said four first stretcher sheets being sealed to said water bag, two of said four first stretcher sheets being sealably connected to two opposing bottom side edges of said internal air bag, a plurality of second stretcher sheets sealably connected to, respectively, said first stretcher sheets and said water bag, and four third stretcher sheets sealably connected to, respectively, said first stretcher sheets and said water bag.

3. The water bed of claim 1 wherein said soft frame comprises a hollow plastic cover layer having stuffing material disposed therein.

4. The water bed of claim 1 wherein said soft frame is an air bag having a plurality of partition stretchers defining said air bag into a plurality of air chambers, said air chambers respectively communicating with one another by air holes defined in said partition stretchers of said soft frame.

5. The water bed of claim 1 wherein said peripheral air bag includes at least one air valve disposed in a corner on a top side thereof, and a plurality of peripheral air bag partition stretchers connected between opposing inside walls thereof and defining the inside space of said peripheral air bag into a plurality of air chambers, each of said peripheral air bag partition stretchers of said peripheral air bag having at least one air hole, which permits air to circulate through said air chambers of said peripheral air bag.

* * * * *